US010518572B2

(12) United States Patent
Damiano et al.

(10) Patent No.: US 10,518,572 B2
(45) Date of Patent: Dec. 31, 2019

(54) PRESSURE DIFFERENCE COMPENSATION MEMBRANE

(71) Applicant: SOCIETE BIC, Clichy (FR)

(72) Inventors: Anne-Lise Damiano, Lagny sur Marne (FR); Olivier Albenge, Outreau (FR); Christelle Debrauwer, St Germain sur Morin (FR)

(73) Assignee: SOCIETE BIC, Clichy (FR)

( * ) Notice: Subject to any disclaimer, the term of this patent is extended or adjusted under 35 U.S.C. 154(b) by 306 days.

(21) Appl. No.: 15/521,372

(22) PCT Filed: Oct. 22, 2015

(86) PCT No.: PCT/FR2015/052836
§ 371 (c)(1),
(2) Date: Apr. 24, 2017

(87) PCT Pub. No.: WO2016/062972
PCT Pub. Date: Apr. 28, 2016

(65) Prior Publication Data

US 2019/0152253 A1 May 23, 2019

(30) Foreign Application Priority Data

Oct. 24, 2014 (FR) ..... 1460229

(51) Int. Cl.
*B43K 5/04* (2006.01)
*B43K 7/08* (2006.01)
*B43K 8/03* (2006.01)

(52) U.S. Cl.
CPC ..... *B43K 5/04* (2013.01); *B43K 7/08* (2013.01); *B43K 8/03* (2013.01)

(58) Field of Classification Search
CPC ... B43K 5/04; B43K 7/08; B43K 8/03; B43K 5/02; B43K 5/10; B43K 7/005;
(Continued)

(56) References Cited

U.S. PATENT DOCUMENTS 3,087,465 A 4/1963 Rubissow
3,854,826 A 12/1974 Adams
(Continued)

FOREIGN PATENT DOCUMENTS

EP 0391083 A1 10/1990
EP 0683062 A1 11/1995
(Continued)

OTHER PUBLICATIONS

International Search Report dated Jan. 26, 2016 from corresponding International PCT Application No. PCT/FR2015/052836, 5 pages.
(Continued)

*Primary Examiner* — David J Walczak
(74) *Attorney, Agent, or Firm* — Ohlandt, Greeley, Ruggiero & Perle, L.L.P.

(57) ABSTRACT

A compensation membrane for compensating a pressure difference between the outside and the inside of a free ink reservoir of a pen or the equivalent, the membrane comprising a first portion having a first rigidity, and a second portion having a second rigidity, the first rigidity being less than the second rigidity. A pen or the equivalent comprising a free ink reservoir provided with such a compensation membrane.

17 Claims, 2 Drawing Sheets

(58) Field of Classification Search
CPC ... B43K 7/01; B43K 7/02; B43K 7/03; B43K 7/035; B43K 8/003; B43K 8/02; B43K 8/022; B43K 8/026; B43K 8/14; B43K 8/146
See application file for complete search history.

(56) References Cited

U.S. PATENT DOCUMENTS

| | | | | |
|---|---|---|---|---|
| 4,472,462 | A * | 9/1984 | Apice | B05C 17/00 260/DIG. 38 |
| 5,738,459 | A * | 4/1998 | Smith | B43K 5/1836 401/188 A |
| 6,102,601 | A * | 8/2000 | Hu | B43K 7/03 401/188 A |
| 2002/0081141 | A1 | 6/2002 | Raps et al. | |
| 2003/0086744 | A1 | 5/2003 | Omatsu et al. | |
| 2004/0109721 | A1 | 6/2004 | Nowak et al. | |

FOREIGN PATENT DOCUMENTS

| | | |
|---|---|---|
| EP | 1085064 | 3/2001 |
| FR | 1047934 | 12/1953 |
| FR | 1326415 | 5/1963 |
| GB | 645705 | 11/1950 |
| GB | 715042 | 9/1954 |
| JP | 7-213982 | 8/1995 |
| JP | 7-214977 | 8/1995 |
| JP | 9-267491 | 10/1997 |
| JP | 2001-80270 | 3/2001 |
| JP | 2001-353467 | 12/2001 |
| JP | 2002541942 | 12/2002 |
| JP | 2006-508834 | 3/2006 |
| WO | 00/63028 A1 | 10/2000 |

OTHER PUBLICATIONS

Japanese Office Action dated Jun. 18, 2019 in corresponding Japanese Patent Application No. 2017-522179, 11 pages.

* cited by examiner

PRESSURE DIFFERENCE COMPENSATION MEMBRANE

FIELD OF THE INVENTION

The invention relates to a membrane for compensating a pressure difference between the inside and the outside of a free ink reservoir of a pen or the equivalent, and also to a free ink reservoir pen provided with such a membrane. A free ink reservoir pen is a pen in which ink is free to flow within the enclosure defined by the reservoir. The invention relates to compensating a pressure difference between the enclosure of such a reservoir and the outside.

TECHNOLOGICAL BACKGROUND

Free ink pens are known that have an ink reservoir connected to a writing tip. Controlling the pressure and the leaktightness of such reservoirs under all circumstances (as the ink is used up or in extreme conditions such as onboard an airplane, at high altitude, at high temperatures, etc.), in particular under conditions that might lead to ink leaking via the writing tip, is a recurrent problem, and no known system is fully satisfactory.

For example, a baffle device is known (also known as a deflector or a labyrinth device) for controlling pressure in the reservoir. Depending on the pressure in the reservoir, the baffle device can become saturated with ink or can become emptied of ink so as to match the pressure inside the reservoir with the outside pressure, with this happening both while ink is being consumed and as a result of accidental pressure variations, while still feeding the writing tip with ink.

However, the baffle device on its own, as is to be found in most conventional pens, is not satisfactory: it operates essentially as a buffer having a vent connected to the outside and capable of storing a limited quantity of ink. Thus, if the ink reservoir is subjected to excessive overpressure, the buffer capacity offered by the baffle device can be insufficient and the pen can leak, e.g. via the vent of the baffle device. Conversely, if the pressure inside the reservoir is lower than outside, situations can arise in which the baffle device no longer manages to prevent the feed of ink to the writing tip being interrupted. There exists a need for a novel type of device for controlling pressure for free ink pens.

SUMMARY OF THE INVENTION

An embodiment provides a compensation membrane for compensating a pressure difference between the outside and the inside of a free ink reservoir of a pen or the equivalent, the membrane comprising a first portion having a first rigidity, and a second portion having a second rigidity, the first rigidity being less than the second rigidity.

In such an embodiment, the compensation membrane may have two or more portions of different rigidities. In addition, the term "pen or the equivalent" is used to cover any writing instrument having a free ink reservoir, and also, more generally, any tool comprising a free ink reservoir connected to a writing tip and that becomes emptied progressively while it is in use, on the same principle as a pen (e.g. a correction pen, an applicator for applying a liquid or pasty substance, etc.).

Under the effect of a pressure difference across the compensation membrane, the first portion deforms and the second portion might possibly deform. Since the first stiffness of the first portion is less than the second stiffness of the second portion, the first portion deforms first or more than the second portion when pressure differences are small. Beyond a certain predetermined pressure difference across the compensation membrane, the second portion deforms on the same basis as the first portion. Deformations continue in this way depending on the number of portions of the compensation membrane, as the pressure difference continues to increase.

When the compensation membrane is mounted on a reservoir, the deformation of the compensation membrane thus makes it possible to compensate the pressure difference between the inside and the outside of the reservoir. In order to be able to compensate this pressure difference, the compensation membrane is naturally leaktight, in particular airtight and tight against the fluid contained in the reservoir (ink or the equivalent). In addition, because of their different rigidities, the first portion and the second portion of the compensation membrane are stressed by thresholds in accordance with the pressure difference. The presence of two portions having different rigidities enables the compensation membrane to have a response that is progressive in order to adapt to variations in pressure difference. The non-linearity of the deformation of the compensation membrane as a function of the pressure difference across said membrane guarantees optimum operation of the reservoir, without any risk of leakage and without any risk of preventing writing, under all overpressure or underpressure conditions inside the reservoir. In particular, slow variation in pressure due to ink being consumed during ordinary use of the pen leads to an immediate small pressure difference that is absorbed mainly by deformations of the first portion, whereas extreme pressure variations due to accidental under- or overpressures (temperature, altitude, shocks, etc.) generating an instantaneous large pressure difference, are absorbed mainly by the deformations of the second portion.

Furthermore, the two rigidities have values that are predetermined in such a manner that the compensation membrane deploys in controlled manner when it is subjected to a predetermined pressure difference, thus offering a controlled volume that is added to or subtracted from the volume of the reservoir. This controlled deployment serves in particular to avoid any formation of an undesirable air pocket or an unusable ink pocket.

When used alone or possibly with other additional devices, such a compensation membrane provides satisfactory management of pressure and prevention of leaks. For example, a pen comprising a free ink reservoir provided with such a compensation membrane serves to compensate the main variations of pressure due to the ink being consumed and to outside conditions, without deforming under the weight of the ink and without applying stresses on the ink. This ensures satisfactory use of the pen. The compensation membrane also constitutes a part that is structurally easy to fabricate and inexpensive compared with known devices for compensating pressure difference.

In certain embodiments, the compensation membrane comprises a third portion having a third rigidity, the third rigidity being greater than the first rigidity and less than the second rigidity. The compensation membrane can then comprise three portions or even more. Such a third portion further improves control over the deployment of the membrane since it provides an additional intermediate threshold enabling continuity of deformation to be managed better between the first portion and the second portion.

In certain embodiments, the portions are concentric. The compensation membrane then deforms with shapes that are easy to predict, thus making it possible to anticipate better the behavior of the compensation membrane with respect to the other components of the pen and to increase its reliability.

In certain embodiments, the compensation membrane comprises a flyweight. The effect of such a flyweight is to add inertia to the compensation membrane, thereby preventing it from responding too violently to stressing that is very rapid. Furthermore, the flyweight acts as a lowpass filter in the sense that it limits the response of the membrane to rapid oscillations in the pressure difference. This limits any risk of the compensation membrane tearing or being damaged.

In certain embodiments, the compensation membrane has substantially an axially symmetric shape. The term "substantially axially symmetric shape" naturally covers a shape that is circular, but also a shape that is oval, elliptical, or the equivalent. It can be understood that the major portions of the membrane, in particular the portions that play a role in its deformation, are axially symmetric. The deformation of the compensation membrane is thus highly predictable and takes place along the direction of the axis of symmetry. The compensation membrane is also easier and less expensive to fabricate.

In certain embodiments, the compensation membrane is configured to be substantially undeformable under the effect of its own weight. It is considered that the compensation membrane is substantially undeformable when its deformation under its own weight is zero or negligible compared with its maximum elastic deformation. In particular, the greatest deformation under its own weight, in particular of the first portion, is at least ten times or at least one hundred times, or indeed at least one thousand times smaller than its maximum elastic deformation. The greatest deformation of a portion is measured as the movement of the physical point of this portion that moves the most. The maximum elastic deformation is the last elastic deformation that can be reached by the material before at least a portion of the compensation membrane suffers plastic deformation.

Because of such a characteristic, it is ensured that the compensation membrane does not vary the pressure in the reservoir in untimely manner by deforming under its own weight depending on the orientation of the reservoir. This ensures that the deformations of the membrane are indeed the consequence of variations of pressure inside or outside the reservoir, the membrane deforming only in order to balance the pressure difference on either side thereof.

In particular, the portions may be configured in such a manner that in the absence of external stressing, the membrane remains or returns to a reference position. Thus, in the mechanical sense of the term, the compensation membrane is elastic. In other words, any deformation of the compensation membrane relative to its rest position gives rise to a stress field in the compensation membrane, which stress field tends to return the compensation membrane to its reference position. The compensation membrane thus operates like a diaphragm that can be unfolded towards the inside or towards the outside of the reservoir. If the compensation membrane is installed on the reservoir with prestress, then in the absence of external stressing, it remains in or returns to a reference position that is different from its natural rest position.

In certain embodiments, the membrane has an undulating shape in its rest position (or at rest). In certain embodiments, the compensation membrane, at rest, comprises at least one annular bend. Such a bend refers to the membrane being folded onto itself. Such a bend or fold may be situated in the vicinity of the junction between two adjacent portions, at the junction between two adjacent portions, or within a portion. Such a bend can constitute a hinge about which the membrane can deform. The presence of at least one annular bend enables the compensation membrane to fold up in its rest position, thereby enabling it to vary the volume of the reservoir considerably when it deploys. In addition, this shape facilitates progressive deployment of the compensation membrane and it returns to the rest position in the absence of stresses.

The present description also provides a pen or the equivalent comprising a free ink reservoir provided with a compensation membrane in accordance with any of the above-described embodiments.

In certain embodiments, the compensation membrane is substantially undeformable under the effect of the weight of the ink. In particular, the deformation of the compensation membrane under the weight of the ink may be negligible compared with its maximum elastic deformation. In particular, the greatest deformation of the first portion under the weight of the ink is at least ten times, or at least one hundred times, or indeed at least one thousand times less than its maximum elastic deformation. The weight of the ink should be understood when the reservoir is maximally filled; it then naturally follows that the membrane does not deform when the reservoir is less filled.

By means of this characteristic, it is ensured that the compensation membrane does not vary the pressure in the reservoir in untimely manner by deforming under the weight of the ink, depending on the orientation of the reservoir.

In certain embodiments, the reservoir extends in a substantially axial direction and has a first axial end opposed to a second axial end, said compensation membrane closing a first opening of the reservoir arranged in the vicinity of the first axial end. A substantially axial direction is a rectilinear direction departing from the axis by no more than twenty degrees, or by no more than ten degrees, or by no more than five degrees, or indeed by no more than two degrees, or indeed a broken line and/or a curved line of mean direction that is substantially axial. Thus, the membrane is placed at a location of the reservoir where its interactions with the other components of the pen can be very limited. The deformations of the membrane thus do not interfere with the other functions of the pen.

In certain embodiments, the reservoir comprises a membrane that is impermeable to liquid and permeable to gas. Such a membrane is often referred to as a "breathing" membrane. Thus, for a free ink reservoir comprising the compensation membrane and the breathing membrane, the compensation membrane and the breathing membrane act together to limit the pressure difference between the inside and the outside of the reservoir. The compensation membrane is particularly useful for accommodating rapid variations in the pressure difference, while the breathing membrane enables slow or long duration pressure differences to be better balanced. In particular, the breathing membrane allows air to penetrate into the reservoir progressively as the ink is consumed, thereby limiting stresses on the compensation membrane.

In certain embodiments, the membrane that is impermeable to liquids and permeable to gas closes a second opening of the reservoir arranged in the vicinity of the second axial end.

Thus, whereas the compensation membrane acts as a pressure compensating device at the first opening of the reservoir, the breathing membrane acts as a pressure compensating device at the second opening of the reservoir. The compensation membrane and the breathing membrane thus act together but without any risk of hindering each other.

In certain embodiments, the reservoir further comprises a baffle device. The compensation membrane protects the baffle device completely from leaks in the event of a shock or overpressure in the reservoir, in particular sudden overpressure. Specifically, the baffle device can become saturated with ink or can become emptied of ink in order to balance pressure between the inside and the outside of the reservoir, but it is necessary for the level of ink in the baffle device to remain within a predetermined range to ensure that the pen suffers neither leaks of ink nor interruptions of writing. The level of ink in the baffle device is controlled automatically by the compensation membrane, which is of dimensions for accommodating part of the pressure unbalance by deforming. The compensation membrane and the baffle device in combination thus ensure that the pen operates properly.

In certain embodiments, the reservoir further comprises a porous and hydrophobic portion. In particular, the porous and hydrophobic portion may have interconnected and open porosity, i.e. porosity in which the pores are accessible at the surface of porous portion and are interconnected. The hydrophobic nature of the porous and hydrophobic portion prevents ink from penetrating therein at rest. In contrast, the porous and hydrophobic portion is capable of receiving ink under a small amount of overpressure (porous aspect) and can do so without becoming completely saturated in ink (hydrophobic aspect). In certain embodiments, the porous and hydrophobic portion can receive ink with ever increasing resistance as the level of ink in the porous and hydrophobic portion increases. Furthermore, within the reservoir provided with the compensation membrane, the porous and hydrophobic portion may be provided on its own or in combination with the baffle device.

In certain embodiments, the reservoir extends in a substantially axial direction and has a first axial end opposed to a second axial end, and the baffle device or the porous and hydrophobic portion close a second opening of the reservoir arranged in the vicinity of the second axial end. The compensation membrane is thus situated at one end of the reservoir, while the baffle device or the porous and hydrophobic portion is situated at the other end of the reservoir and closes the reservoir. In a variant, the reservoir may have both a baffle device and a porous and hydrophobic portion. For example, the baffle device and the porous and hydrophobic portion both close the second opening of the reservoir, these two elements being arranged in series. For example, relative to the reservoir, the baffle device may be in contact with the inside of the reservoir while the porous and hydrophobic portion may be in contact with the outside of the reservoir.

Thus, at the second opening, the baffle device or the porous and hydrophobic portion are capable of absorbing a certain quantity of ink depending on the pressure difference between the inside and the outside of the reservoir. The baffle device or the porous and hydrophobic portion thus contribute together with the compensation membrane to compensating the pressure difference between the inside and the outside of the reservoir. The positioning of the baffle device or of the porous and hydrophobic portion in the vicinity of the second axial end is particularly compact and possibly provides a fluid flow connection between the reservoir and the other components of the pen, e.g. the writing tip. For example, when the compensation membrane closes the first opening, the fact that the baffle device or the porous and hydrophobic portion closes the second opening axially opposed to the first opening enables each component to operate in complementary manner without any risk of impeding one another. Thus, the compensation membrane does not hinder the operation of the baffle device or of the porous and hydrophobic portion, and vice versa. For example, the compensation membrane may be situated at the rear end of the reservoir where it is free to deploy. For example, the baffle device and/or the porous and hydrophobic portion may be positioned at the front end of the reservoir, in the vicinity of the writing tip, with an appropriate structure for connecting the writing tip to the reservoir.

In certain embodiments, the membrane that is impermeable to liquids and permeable to gas and the baffle device or the porous and hydrophobic portion close the second opening, said membrane being adjacent to the baffle device or to the porous and hydrophobic portion, the baffle device or the porous and hydrophobic portion being arranged on the inside of the reservoir relative to said membrane. Consequently, at the second opening, the breathing membrane is in contact with the outside of the reservoir and the baffle device or the porous and hydrophobic portion is in contact with the inside of the reservoir.

Thus, the breathing membrane makes the reservoir leak-tight for ink while allowing gas and in particular air to pass through, while the baffle device and/or the porous and hydrophobic portion protects the breathing membrane, which could become clogged and lose its permeability to air if it were in direct or frequent contact with the ink. Using a breathing membrane and a baffle device or a porous and hydrophobic portion simultaneously provides a synergistic effect of protecting and preserving the functions of each of these components.

Furthermore, the combination of a compensation membrane with a breathing membrane and a baffle device or a porous and hydrophobic portion makes it possible to obtain small underpressure in the reservoir. This small underpressure is necessary for compensating the weight of the ink on the writing tip when the writing tip is pointing downwards. Consequently, the combination of a compensation membrane with a breathing membrane and a baffle device and/or a porous and hydrophobic portion makes it possible not only to control sudden variations in the pressure difference between the inside and the outside of the reservoir, but also to compensate for the weight of the ink on the writing tip of the pen and to admit air into the reservoir progressively as the ink is used up, thereby further optimizing use of the pen.

In certain embodiments, the first axial end is at an opposite side from a writing tip relative to the second axial end. Thus, the writing tip, the second axial end, and the first axial end are arranged in that order along the pen, the first axial end of the reservoir being provided with the compensation membrane. The compensation membrane can thus move freely without risk of being hindered by or of hindering the writing function of the pen, and on the contrary it can adapt the size of the reservoir so as to ensure that ink can always flow.

BRIEF DESCRIPTION OF THE DRAWINGS

The invention and its advantages can be better understood on reading the following detailed description of embodiments given as non-limiting examples. The description refers to the accompanying sheets of drawings, in which.

DETAILED DESCRIPTION OF THE INVENTION

Figure 1:
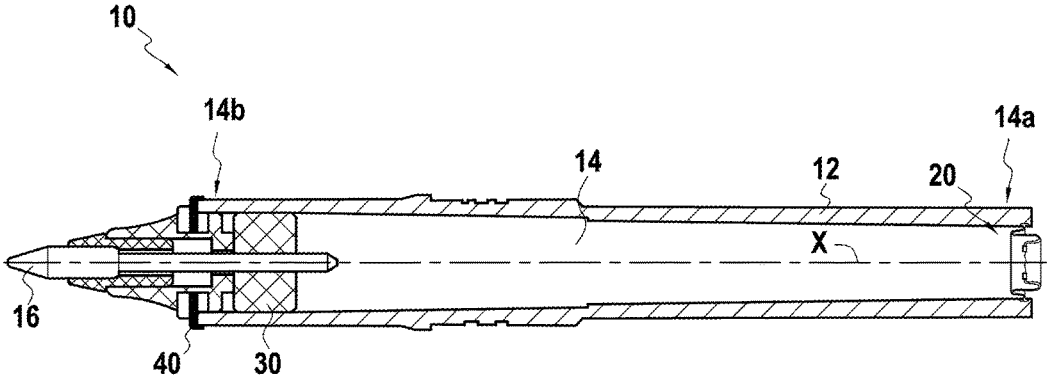
FIG. 1 shows a first embodiment of a pen, seen in cross-section, fitted with a compensation membrane and a portion that is porous and hydrophobic.

FIG. 1 is a cross-section view of a free ink pen 10 (referred to below, for short, as a "pen") in a first embodiment. The pen 10 comprises a barrel 12 forming a reservoir 14 in which the ink (not shown) is free to flow. The barrel 12 may have raised portions or internal or external shapes, e.g. to enable it to be assembled with other parts of the pen. The shapes or raised portions of the barrel 12 may also be merely for an appearance effect.

As shown in FIG. 1, the reservoir 14 extends in a substantially axial direction X. The pen 10 has a writing tip 16 in fluid flow communication with the reservoir 14. The writing tip 16 may be any kind of tip, in particular a ballpoint, a felt tip, a pen nib, or any otherwise known type of tip. The connection between the writing tip 16 and the reservoir 14 is adapted to the type of tip in ways that are known in the prior art. In FIG. 1, there can be seen a writing tip 16 comprising a ballpoint with a fiber connector directly connected to the reservoir 14.

The pen 10 has a compensation membrane 20, a portion 30 that is porous and hydrophobic, and a breathing membrane 40. The compensation membrane 20 closes a first opening of the reservoir 14 arranged in the vicinity of a first axial end 14*a*. Specifically, the first axial end 14*a* is the end of the reservoir 14 opposed to the writing tip 16. The structure and the operation of the compensation membrane 20 are described below.

The porous and hydrophobic portion 30 closes a second opening situated at a second axial end 14*b* of the reservoir 14. The second axial end 14*b* is opposed to the first axial end 14*a*. The second axial end 14*b* is situated beside the writing tip 16.

The breathing membrane 40 also closes the second opening. More precisely, it is adjacent to the porous and hydrophobic portion 30, the porous and hydrophobic portion 30 being arranged on the inside of the reservoir 14 relative to the breathing membrane 40. The breathing membrane 40 and the porous and hydrophobic portion 30 may be adjacent directly or indirectly, i.e. there might be one or more elements between them.

The compensation membrane 20 has an actuation threshold. In other words, it is designed to be deformed only from a predetermined pressure difference between the inside and the outside of the reservoir 14. This makes it possible in particular for the reservoir 14 to be at slightly reduced pressure. In particular, when the pen 10 is held with its tip at the bottom, the porous and hydrophobic portion 30 absorbs some of the ink, thereby creating a small amount of suction in the reservoir 14. This suction is small enough not to be compensated by a movement of the compensation membrane 20, it serves to compensate the weight of the ink on the writing tip 16, and thus serves to avoid ink dripping from the writing tip 16. In addition, the breathing membrane 40 prevents the reservoir 14 from leaking in the event of the porous and hydrophobic portion 30 being saturated with ink.

Because of its impermeability to liquids and permeability to gases, the breathing membrane 40 allows air to penetrate into the reservoir 14. Air can also pass without difficulty through the porous and hydrophobic portion 30. This assembly of the breathing membrane 40 and the porous and hydrophobic portion 30 thus operates like a vent, allowing air to enter or leave the reservoir 14, and this, in combination with the compensation membrane 20, enables the pressure inside the reservoir 14 to be controlled as a function of the outside pressure.

In the present embodiment, the compensation membrane 20 is configured to be stressed solely in its elastic deformation range. The compensation membrane 20 is thus configured to return to its reference position (its shape) in the absence of external stress. As mentioned above, the compensation membrane 20 serves to absorb large and/or rapid variations of pressure. For this purpose, the compensation membrane 20 deforms, thereby creating stresses internal to the compensation membrane 20, said stresses seeking to return the compensation membrane 20 to its reference position as soon as that is compatible with balancing pressures inside and outside the reservoir 14.

Figure 2:
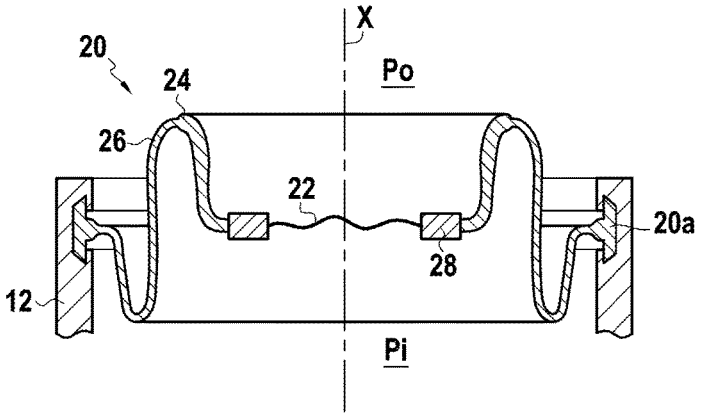
FIG. 2 shows a detail of the FIG. 1 compensation membrane in its rest state.

The structure of the compensation membrane 20 is described in detail below with reference to FIG. 2. In FIG. 2, the compensation membrane 20 is shown in axial cross-section and in a rest position, i.e. a position in which the difference between the inside pressure Pi (pressure inside the reservoir 14), and the outside pressure Po (pressure outside the reservoir 14) is less than the actuation threshold of the compensation membrane 20.

The compensation membrane 20 has a first portion 22 having first stiffness K1, a second portion 24 having second stiffness K2, and a third portion 26 having third stiffness K3. In the example shown, the first stiffness is less than the third stiffness, which is in turn less than the second stiffness (i.e. $K1<K3<K2$). The greater the rigidity of a portion, the greater the forces needed to deform that portion. Furthermore, as shown in FIG. 2, each portion has an undulating or equivalent shape when the pressure difference on either side of the compensation membrane is less than the actuation threshold of the compensation membrane. The presence of undulations or convolutions serves to release a larger volume when the portion is deployed.

Furthermore, the radial order of the portions 22, 24, and 26 of different rigidities may be modified relative to the order shown in FIG. 2.

The portions 22, 24, and 26 of the compensation membrane 20 may be made of different materials or they may be made of the same material. In particular, when they are made of the same material, in order to obtain different rigidities, the portions may have different thicknesses. As shown in FIG. 2, in this example, each portion has rigidity that increases with increasing thickness of the portion. Specifically, the first portion 22 is thinner than the third portion 26, which is in turn thinner than the second portion 24. For example, at least one portion may be made of polymer material, in particular of silicone or of thermoplastic elastomer. When the compensation membrane is made of a plurality of materials, it may be made by bi-injection, by tri-injection, or by putting inserts into place.

In the present embodiment, the portions 22, 24, and 26 of the compensation membrane are concentric about an axis X. Furthermore, they are substantially axially symmetric about the axis X.

In FIG. 2, it can be seen that the compensation membrane 20 is fastened to the barrel 12 by a radially outer portion 20*a*. Nevertheless, the compensation membrane could be directly injected or co-injected when injecting the barrel 12, thereby further improving the leaktightness of the reservoir 14.

The compensation membrane 20 also has a flyweight 28. Specifically, the flyweight is annular and has an axially symmetric shape, so as to avoid disturbing the general symmetry of the compensation membrane 20. The flyweight 28 is arranged between the first portion 22 and the second portion 24. The flyweight 28 increases the inertia of the compensation membrane 20.

Figure 3A:
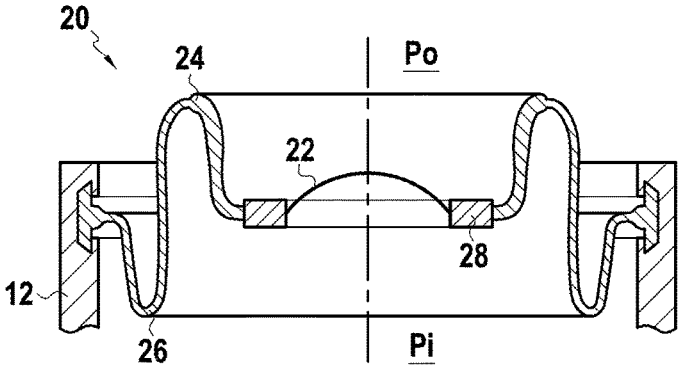
FIGS. 3A, 3B and 3C show the successive steps in deploying the FIG. 2 compensation membrane during a relative increase of pressure in the reservoir of the pen.
Figure 3B:
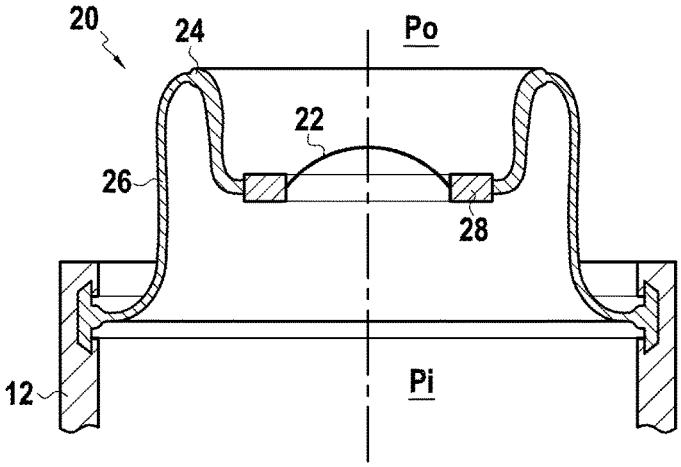

The operation of the compensation membrane 20 is described in detail below with reference to FIGS. 3A-3C, which show a plurality of successive states of deformation of the compensation membrane 20. The succession of states in FIGS. 3A-3C occurs when the difference between the inside pressure and the outside pressure (Pi−Po) is positive and increasing. Naturally, opposite deformation (towards the inside of the reservoir), as obtained when the pressure difference Pi−Po is negative and decreasing, is analogous and is not described in detail.

An initial state is shown in FIG. 2. In FIG. 2, all three portions 22, 24, and 26 are in the rest state (where they have a substantially undulating shape), which means that the pressure difference Pi−Po is of absolute value smaller than the actuation threshold of the compensation membrane 20.

When the inside pressure increases or the outside pressure decreases, e.g. under the effect of high temperature or altitude, the difference Pi−Po increases. When it crosses the actuation threshold of the compensation membrane 20, the compensation membrane begins to deform. The first portion 22, having the lowest rigidity K1, begins to deform towards the outside of the reservoir 14 in order to increase the volume of the reservoir 14, and thus cause the inside pressure Pi to decrease. This state is shown in FIG. 3A. The second and third portions 24 and 26, of respective rigidities K2 and K3 that are greater than the first rigidity K1, substantially retain their original shapes. This state defines a first regime in which variations in the pressure difference are accommodated mainly by deformation of the first portion 22.

The three respective rigidities K1, K2, and K3 of the portions 22, 24, and 26 define three successive regimes for variation in the deformation of the compensation membrane 20 as the pressure difference Pi−Po increases. In each regime, variations of the pressure difference are accommodated mainly by deformation of a given portion; the portions that are less rigid than the given portion are stretched (i.e. they are already deformed towards the outside), while the portions that are more rigid than this given portion are substantially relaxed (i.e. deformed little or not yet). For example, an intermediate state is shown in FIG. 3B. In this intermediate state, the pressure difference is accommodated mainly by the third portion 26. The first and third portions 22 and 26 are deformed towards the outside, while the portion 24 having the greatest rigidity is deformed little or not at all. In other words, the pressure forces are sufficient to deform the first and third portions 22 and 26, but not to deform the second portion 24.

If the difference Pi−Po increases further, the various portions of the compensation membrane 20 continue to deform on the same principle, in the order of their increasing rigidities and in the successive regimes, until reaching a state in which all of the portions 22, 24, and 26 are deployed towards the outside. This is the state shown in FIG. 3C.

Because of the various rigidities and shapes of the various portions 22, 24, and 26, the compensation membrane 20 may be said to be a controlled deployment membrane.

Furthermore, the respective rigidities K1, K2, and K3 of the portions 22, 24, and 26 are preferably dimensioned in such a manner that the deformations of the compensation membrane 20 remain in the elastic ranges of the portions 22, 24, and 26. Thus, when the pressure difference Pi−Po becomes once more less than the actuation threshold of a portion, said portion returns substantially to its reference position. Consequently, in this sense, the compensation membrane 20 can be said to be a shape memory membrane. In other words, and in general manner, the membrane is thus configured to remain in or to return to its rest position in the absence of external stress, there being only one such position.

Figure 3C:
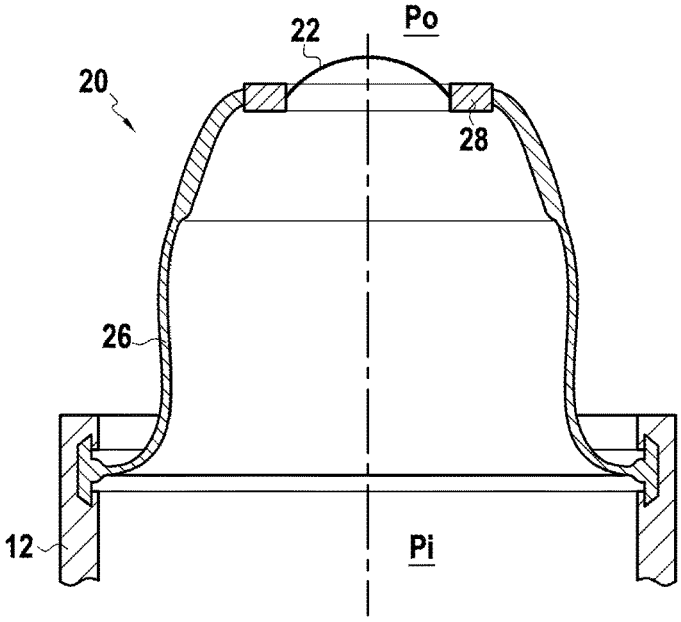

More precisely, starting from the state of FIG. 3C, if the pressure difference Pi−Po decreases, then the compensation membrane 20 returns to the rest state in the reverse order to the steps described above. Starting from the rest state shown in FIG. 2, if the pressure difference Pi−Po decreases further, then the compensation membrane 20 deforms towards the inside of the reservoir 14; the portions 22, 24, and 26 then deform in the order of their respective increasing rigidities.

Figure 4:
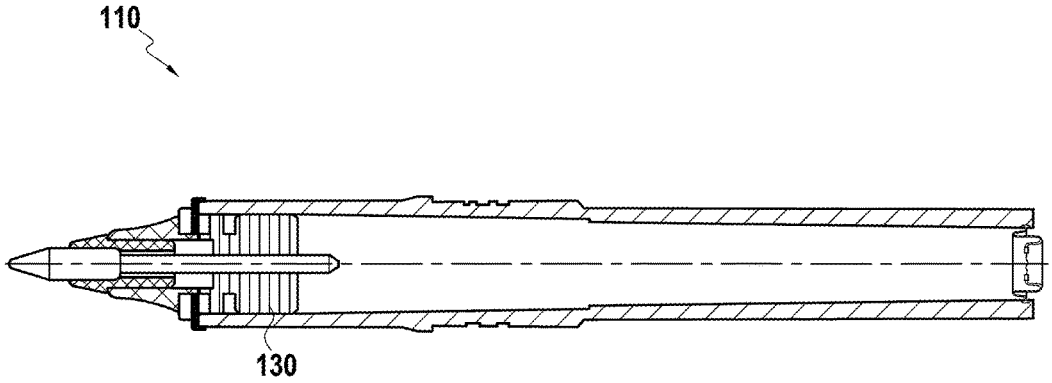
FIG. 4 shows a second embodiment of a pen seen in cross-section, fitted with a compensation membrane and with a baffle device.

FIG. 4 shows a free ink pen in another embodiment. The pen 110 of FIG. 4 is identical to the pen 10 of FIG. 1, except that the porous and hydrophobic portion 30 is replaced by a baffle device 130. The baffle device 130 has an air passage and the baffles are suitable for storing a quantity of ink that is a function of the pressure difference across the baffle device 130. Thus, the baffle device 130 can perform the same functions as the porous and hydrophobic portion 30. Nevertheless, its reliability is guaranteed only because of its co-operation with the breathing membrane 40 and the compensation membrane 20, which remain unchanged in this embodiment. In a variant, the pen 110 could also have a porous and hydrophobic portion arranged in series with the baffle device 130.

Although the present invention is described with reference to specific embodiments, modifications may be applied to those embodiments without going beyond the general ambit of the invention, as defined by the claims. In particular, the individual characteristics of the various embodiments that are shown and/or mentioned may be combined in additional embodiments. Consequently, the description and the drawings should be considered in a sense that is illustrative rather than restrictive.

The invention claimed is:

1. A compensation membrane for compensating a pressure difference between an outside and an inside of a free ink reservoir of a pen, the compensation membrane comprising a first portion having a first rigidity, a second portion having a second rigidity, the first rigidity being less than the second rigidity, and a flyweight disposed between the first portion and the second portion.

2. The compensation membrane according to claim 1, further comprising a third portion having a third rigidity, wherein the third rigidity is greater than the first rigidity and less than the second rigidity.

3. The compensation membrane according to claim 1, wherein the first and second portions are concentric.

4. The compensation membrane according to claim 1, wherein the flyweight is annular in shape and is positioned axially symmetric with respect to the compensation membrane such that the flyweight increases an inertia of the compensation membrane.

5. The compensation membrane according to claim 1, wherein the compensation membrane is substantially axially symmetric in shape.

6. The compensation membrane according to claim 1, wherein the compensation membrane is configured to be stressed solely according to an elastic deformation range of the material used to form the compensation membrane.

7. A pen comprising a free ink reservoir provided with the compensation membrane according to claim 1.

8. The pen according to claim 7, wherein the free ink reservoir extends in a substantially axial direction and has a first axial end opposed to a second axial end, the compensation membrane is configured to extend axially across the first axial end and is positioned to close a first opening of the free ink reservoir arranged in the vicinity of the first axial end.

9. The pen according to claim 8, wherein the free ink reservoir includes a breathing membrane that is impermeable to liquids and permeable to gas, wherein the breathing membrane is configured to extend axially across the second axial end and is positioned to close a second opening of the free ink reservoir arranged in the vicinity of the second axial end.

10. The pen according to claim 8, wherein the first axial end is at an opposite side from a writing tip relative to the second axial end.

11. The pen according to claim 7, wherein the free ink reservoir includes a breathing membrane that is impermeable to liquid and permeable to gas.

12. The pen according to claim 7, wherein the free ink reservoir further includes a baffle device.

13. The pen according to claim 12, wherein the free ink reservoir extends in a substantially axial direction and has a first axial end opposed to a second axial end, wherein the baffle device is configured to extend axially across the second axial end and is positioned to close a second opening of the free ink reservoir arranged in the vicinity of the second axial end.

14. The pen according to claim 13, wherein the free ink reservoir includes a breathing membrane that is impermeable to liquids and permeable to gas, wherein the breathing membrane is configured to extend axially across the second axial end, wherein the baffle device is arranged on an inside of the free ink reservoir adjacent to the breathing membrane, and wherein the breathing membrane and the baffle device are positioned to close the second opening.

15. The pen according to claim 7, wherein the free ink reservoir further includes a porous and hydrophobic portion.

16. The pen according to claim 15, wherein the free ink reservoir extends in a substantially axial direction and has a first axial end opposed to a second axial end, wherein the porous and hydrophobic portion is configured to extend axially across the second axial end and is positioned to close a second opening of the reservoir arranged in the vicinity of the second axial end.

17. The pen according to claim 16, wherein the free ink reservoir includes a breathing membrane that is configured to extend axially across the second axial end, wherein the porous and hydrophobic portion are arranged on the inside of the free ink reservoir adjacent to the breathing membrane, and wherein the breathing membrane and the porous and hydrophobic portion are positioned to close the second opening.

* * * * *